US007952341B2

(12) United States Patent
Schulz

(10) Patent No.: US 7,952,341 B2
(45) Date of Patent: May 31, 2011

(54) MULTI-STABLE ELECTRONIC CIRCUIT STATE CONTROL

(75) Inventor: Frank Joseph Schulz, Ottawa (CA)

(73) Assignee: Power Integrations, Inc., San Jose, CA (US)

( * ) Notice: Subject to any disclaimer, the term of this patent is extended or adjusted under 35 U.S.C. 154(b) by 410 days.

(21) Appl. No.: 12/137,367

(22) Filed: Jun. 11, 2008

(65) Prior Publication Data

US 2009/0309569 A1 Dec. 17, 2009

(51) Int. Cl.
*G05F 3/16* (2006.01)

(52) U.S. Cl. ..... 323/312; 327/539; 137/187

(58) Field of Classification Search ..... 323/282–288, 323/280, 297, 222, 312–316, 268, 271, 906; 327/295, 530, 536, 538, 541, 539; 363/21.13, 363/21.15, 16, 17; 137/187
See application file for complete search history.

(56) References Cited

U.S. PATENT DOCUMENTS 4,234,841 A * 11/1980 Schade, Jr. ..... 323/268
6,124,704 A * 9/2000 Annema ..... 323/313
7,286,002 B1 * 10/2007 Jackson ..... 327/539

* cited by examiner

*Primary Examiner* — Rajnikant B Patel
(74) *Attorney, Agent, or Firm* — Blakely Sokoloff Taylor & Zafman, LLP

(57) ABSTRACT

Apparatus and methods of controlling operating states of multi-stable electronic circuits are disclosed. In one aspect, an apparatus includes a bandgap reference circuit having an operating state and a latched off state. The bandgap reference circuit includes an amplifier to provide a bandgap reference voltage when the bandgap reference circuit is in the operating state. A state control circuit is also included and is coupled to sense an output signal of the bandgap reference circuit. The state control circuit is also coupled to provide a drive signal to an input of the amplifier in response to the sensed output signal. The drive signal is coupled to cause the bandgap reference circuit to avoid the latched off state.

19 Claims, 2 Drawing Sheets

MULTI-STABLE ELECTRONIC CIRCUIT STATE CONTROL

FIELD OF THE DISCLOSURE

The present invention relates generally to multi-stable self-biasing electronic circuits and, in particular, to arrangements for avoiding undesired states of such circuits.

BACKGROUND

Multi-stable electronic circuits are quite common, and are used for various purposes. Certain types of bandgap reference circuits, for example, have two stable operating states, including a normal operating state in which a reference voltage is provided at an output and an off state in which the output level is zero. On power up, the output level of such a bandgap reference circuit initially starts at 0 Volts, which is the correct voltage for one of the stable operating states. The circuit may actually remain in its latched off state after being powered up.

This startup problem might not be encountered where there are large amounts of circuit noise or some sort of startup circuit to bias the bandgap reference circuit toward its normal operating state. One conventional way to start up a bandgap reference circuit is to use a pull-up resistor or transistor at its output. As the power supply rises from 0 Volts, the pull-up provides a bias current, which causes the bandgap reference circuit to favor and snap into its normal operating state.

Many bandgap reference circuits include an operational amplifier or "opamp" to generate the reference voltage. Once the power supply is at a high enough level for the opamp to function properly, the current required to pull the bandgap reference circuit out of a latched off state condition can be quite high, especially if the output stage of the opamp has a strong current sinking capability, as is typically the case.

In general, a pull-up should be able to overdrive the output of an opamp while power supply voltage is too low for the opamp to be functional. However, if a bandgap reference circuit shuts off after it was fully operational, due to noise or other conditions for instance, the pull-up might not be strong enough to overdrive the opamp output and the bandgap can remain latched off.

The above issues relating to a latched off state similarly apply to other types of multi-stable circuits, which may enter and remain in an undesired state.

BRIEF DESCRIPTION OF THE DRAWINGS

Non-limiting and non-exhaustive examples of the present invention are described with reference to the following figures, wherein like reference numerals refer to like parts throughout the various views unless otherwise specified.

DETAILED DESCRIPTION

Methods and apparatuses for implementing state control of multi-stable electronics circuit are disclosed. In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or subcombinations in one or more embodiments or examples. In addition, it is appreciated that the figures provided herewith are for explanation purposes to persons ordinarily skilled in the art and that the drawings are not necessarily drawn to scale.

Figure 1:
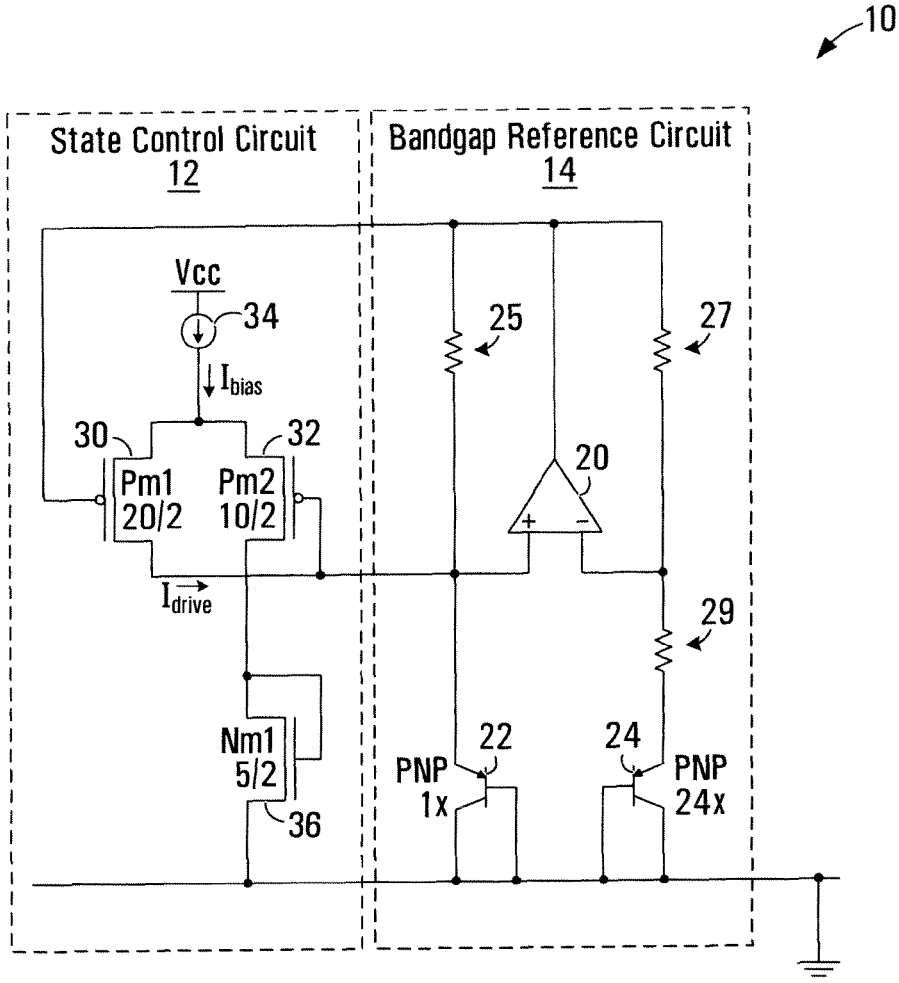
FIG. 1 is an example schematic of an apparatus in accordance with the teachings of the present invention.

To illustrate, FIG. 1 shows generally an example schematic of an apparatus in accordance with the teachings of the present invention. As shown in the depicted example, the apparatus 10 includes a state control circuit 12 and a bandgap reference circuit 14. The bandgap reference circuit 14 includes an amplifier 20, transistors 22 and 24, and resistors 25, 27 and 29. The state control circuit 12 includes transistors 30, 32 and 36 and a current source 34.

It should be appreciated that the apparatus 10 of FIG. 1, as well as the contents of the other drawings, are provided for explanation purposes, and that the teachings of the present invention are not limited to the specific examples shown in the drawings and described herein. For instance, other examples in accordance with the teachings of the present invention may include additional, fewer and/or different components that are coupled in a similar or different manner in accordance with the teachings of the present invention.

As shown in the example depicted in FIG. 1, bandgap reference circuit 14 includes an amplifier 20, which is illustrated in FIG. 1 in the form of an opamp, and PNP Bipolar Junction Transistors (BJTs) 22 and 24. Other types of amplifiers and/or controllable switches may be used in different implementations of a bandgap reference circuit. Such implementations may similarly use different feed and/or gain arrangements than the resistors 25, 27 and 29. Examples in accordance with the teachings of the present invention are also not restricted to implementation of the example state control circuit 12 using Field Effect Transistors (FETs) 30, 32 and 36, as shown, or the specific arrangement of transistors 30, 32 and 36 shown in FIG. 1. The present disclosure will enable those skilled in the art to which the present invention pertains to implement examples in accordance with the teachings of the present invention in other ways as well, using various forms of state control circuits in conjunction with similar or different bandgap reference circuits or other multi-stable circuits.

In the normal operating state of the example bandgap reference circuit 14 shown in FIG. 1, the output of the amplifier 20 provides a bandgap reference voltage that is close to the theoretical bandgap of silicon at 0° K. Each PNP transistor 22 and 24 has its control terminal, which is a base terminal in the example case of BJTs as shown, and its conductive path, specifically its collector terminal in the example in FIG. 1, coupled to ground. The conductive path of the transistor 22 is coupled through its emitter terminal to the non-inverting input of the amplifier 20, and to the output of the amplifier 20 through the resistor 25. The conductive path of the transistor 24 is similarly coupled through its emitter terminal to the output of the amplifier 20, but through two resistors 27 and 29. The inverting input of the amplifier 20 is coupled to a junction point between the resistors 27 and 29.

In one example, feed resistors 25 and 27 normally have the same resistance, which results in the currents through the emitter/collector conductive paths of the transistors 22 and 24 being equal. The different effective emitter sizes of the transistors 22 and 24, however, denoted in FIG. 1 as "1×" and "24×" to indicate that the total emitter area of the transistor 24 is 24 times that of the transistor 22, results in a higher current density in the emitter of transistor 22. In one example, the gain setting resistor 29 is selected to have a resistance of one-tenth to one-eighth the resistance of the feed resistors 25 and 27.

In the illustrated example, the output of bandgap reference circuit 14 is the output of amplifier 20. In one example, the output of the amplifier 20 is generally 1.2V to 1.3V when the bandgap reference circuit 14 is in its normal operating state. With the arrangement shown in FIG. 1, and specifically the different emitter areas of the transistors 22 and 24, the output bandgap reference signal is also temperature compensated.

When powered on, the bandgap reference circuit 14 becomes a bi-stable circuit with one of two stable operating points appearing at the output of amplifier 20. The desired operating state is with an output voltage of 1.2V in some examples, although different output levels may be desired in other examples. In the undesired state, the output of amplifier 20 is latched at 0V.

During startup, the output of the amplifier 20 initially starts at 0V in the depicted example. The polarity of the input offset of the amplifier 20 can make the bandgap reference circuit 14 favor its off state, and as noted above the circuit may remain in the off state after being powered up. Conventional startup arrangements using pull-up resistors or transistors connected to the output of the amplifier 20 overdrive the output of amplifier 20. Large currents can be required, especially after power supply voltage becomes large enough for the amplifier 20 to operate normally. As will be shown, examples in accordance with the teachings of the present invention provide a different approach.

In the latched off state, no current flows through the feed resistors 25 and 27 or the gain setting resistor 29. In the illustrated example, the state control circuit 12 detects the current flowing through one of the resistors, such as the resistor 25 in the depicted example, and generates a drive signal Idrive that is provided to an input of amplifier 20. Other sensing arrangements are also possible in accordance with the teachings of the present invention. For example, the voltages across the resistors 27 and 29, separately or in combination, are also indicative of the output level of the bandgap reference circuit and could be used to sense the output level. It would also be possible to provide separate elements to enable sensing of the output level of the bandgap reference circuit 14 in accordance with the teachings of the present invention.

As shown in the example depicted in FIG. 1, the drive signal Idrive is in the form of a current that flows into the transistor 22, which is coupled to the non-inverting input of amplifier 20 in apparatus 10. This bootstraps the bandgap reference circuit 14, which results in a current flowing through the resistors 25, 27 and 29. As the output voltage of the bandgap reference circuit 14 increases from 0V to its reference voltage, which in one example is 1.2V, the current through the resistor 25 increases and the drive signal Idrive tapers off. In one example, the drive signal Idrive tapers off to 0 by the time the output of the amplifier 20 reaches the reference voltage.

The state control circuit 12 thus detects the operating state of the bandgap reference circuit 14 (on or latched off) by effectively monitoring the current flowing through the transistor 22 that is connected to the positive input node of the amplifier 20. When the bandgap reference circuit is off, a current is injected into this node, pulling the output of the bandgap reference circuit 14 out of its latched off state.

In one example, the state control circuit 12 includes a differential input pair, which in the example shown in FIG. 1 includes transistor Pm1 30 and transistor Pm2 32. A current source 34 provides a current Ibias coupled to be received by the differential pair, and a transistor Nm1 36 coupled to transistor Pm2 32 as a dummy load. Although the dummy load provided by the transistor Nm1 36 is useful to balance the drain-source voltages of the transistors Pm1 30 and Pm2 32, it is appreciated that a dummy load is optional for operation of the state control circuit 12. In another example, transistor Pm2 32 could instead be coupled to ground directly, without a dummy load.

In one example, state control circuit 12 determines whether the bandgap reference circuit 14 is on or off by sensing the current flowing through the resistor 25.

To illustrate, the voltage across the resistor 25, which is proportional to the current flowing through the resistor 25, is applied to the gate terminals of the differential input pair transistor Pm1 30 and transistor Pm2 32. When the bandgap reference circuit 14 is off, no current flows through the resistor 25, and the gate voltages of transistor Pm1 30 and transistor Pm2 32 are equal. Normally, this causes the drain currents of the differential pair transistor Pm1 30 and transistor Pm2 32 to be equal, except that transistor Pm1 30 and transistor Pm2 32 are different sizes. In one example, transistor Pm1 30 is twice as large as transistor Pm2 32 in the apparatus 10. As shown in FIG. 1, transistor Pm1 30 has a channel width twice that of transistor Pm2 32. Therefore, the drive current Idrive, which as shown is the transistor Pm1 30 drain current, is ⅔ of Ibias, with the other ⅓ of Ibias flowing through transistor Pm2 32 into the dummy load transistor Nm1 36. This unequal split of Ibias through transistor Pm1 30 and transistor Pm2 32 allows a smaller Ibias to be used to supply the drive current Idrive. Ratios other than the 2 to 1 ratio shown in FIG. 1 could be used in other examples in accordance with the teachings of the present invention.

In the depicted example, the drive current Idrive raises the non-inverting input of amplifier 20, causing the bandgap reference circuit 14 to bootstrap itself into operation, resulting in the desired reference voltage at the output of amplifier 20. As the bandgap reference circuit 14 turns on, the voltage across the resistor 25 increases, which in turn decreases the gate to source voltage of transistor Pm1 30, gradually turning transistor Pm1 30 off. This results in substantially all of the Ibias current being carried by transistor Pm2 32 off into the dummy load transistor Nm1 36. In other examples, a drive signal may be provided to the inverting input of amplifier 20, or possibly to some other node at the input side of amplifier 20 in accordance with the teachings of the present invention.

Thus, FIG. 1 illustrations one particular example implementation of an apparatus 10 that includes a bandgap reference circuit 14 having an operating state and a latched off state in accordance with the teachings of the present invention. The bandgap reference circuit 14 includes an amplifier 20 that is operable to provide a bandgap reference voltage when the bandgap reference circuit is in the operating state. The apparatus 10 also includes a state control circuit 12 that is coupled to the bandgap reference circuit 14, the state control circuit being operable to sense an output signal of the bandgap reference circuit 14 and to provide a drive signal Idrive at an input of the amplifier 20 responsive to the sensed output signal of the bandgap reference circuit 14. The drive signal Idrive causes the bandgap reference circuit 14 to avoid the latched off state in accordance with the teachings of the present invention.

The transistors 30 and 32 shown in FIG. 1 are illustrative examples of controllable switches that are coupled together in a differential input pair. Each of the controllable switches has a control terminal, which is shown as a gate terminal in FIG. 1, and a conductive path, which is the source/drain path in the case of the transistors 30 and 32 as shown in FIG. 1. The sensed output signal of the bandgap reference circuit 14 is coupled across the control terminals, and the conductive path of one of the controllable switches, the transistor 30, is coupled to the input of the amplifier 20 to provide the drive signal. In the apparatus 10, the current flowing into the transistor 22 is sensed by sensing the voltage across the resistor 25. The conductive path of the other controllable switch, the transistor 32, is coupled to a dummy load, which is in the form of transistor Nm1 36 in the example apparatus 10 shown in FIG. 1. The current source 34 is coupled to the conductive paths of both of the controllable switches, i.e., the source/drain paths of the transistors 30 and 32.

The bandgap reference circuit 14 as illustrated in FIG. 1 is similarly illustrative of one possible example in accordance with the teachings of the present invention. As shown, the amplifier 20 of the bandgap reference circuit 14 has non-inverting and inverting inputs and an output. Transistors 22 and 24 are coupled to the non-inverting and inverting inputs, respectively, of the amplifier 20, and are further coupled to the output of the amplifier 20. The state control circuit 12 provides the drive signal to the transistor 22 that is coupled to the non-inverting input of the amplifier 20, as shown.

As shown in the example depicted in FIG. 1, resistors 25, 27 and 29 are also provided in the bandgap reference circuit 14. Resistor 25 is coupled between the non-inverting input of amplifier 20 and the output of amplifier 20. Resistor 27 is coupled between the inverting input of amplifier 20 and the output of amplifier 20. In addition, resistor 29 is coupled between the inverting input of the amplifier 20 and transistor 24. The non-inverting input of amplifier 20 is coupled to transistor 22.

Figure 2:
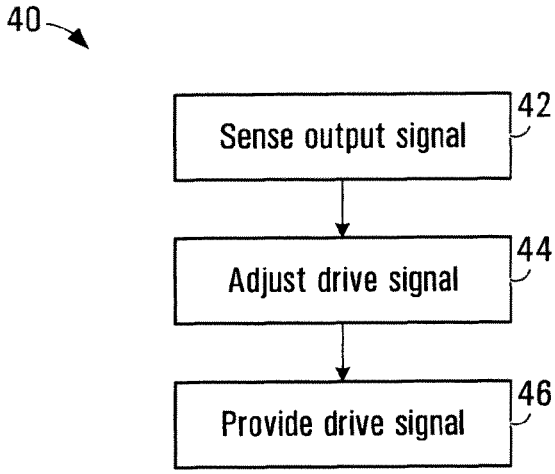
FIG. 2 is an example flow diagram illustrating a method in accordance with the teachings of the present invention.

It is appreciated that the examples discussed above are described primarily in the context of an apparatus. Other examples in accordance with the teachings of the present invention are also contemplated. FIG. 2, for instance, illustrates generally an example flow diagram that describes a method in accordance with the teachings of the present invention. As shown in FIG. 2, a method 40 includes an operation 42 in which an output of a bandgap reference circuit is sensed. The bandgap reference circuit has an operating state and a latched off state and includes an amplifier that is operable to provide a bandgap reference voltage when the bandgap reference circuit is in the operating state. In one example, the bandgap reference circuit may be implemented as shown in FIG. 1. A drive signal is generated or adjusted in operation 44 on the basis of the sensed output signal. In operation 46, the drive signal is provided at an input of the amplifier. The drive signal causes the bandgap reference circuit to avoid the latched off state.

It should be appreciated that the method 40 represents one illustrative example in accordance with the teachings of the present invention. Other examples for instance may include additional, fewer, or different operations performed in a similar or different order. The operations shown in FIG. 2 may also be performed in various ways, at least some of which will be evident from the foregoing description of the example apparatus 10 described in FIG. 1.

Although described above primarily in the context of an illustrative example application to bandgap reference circuits, examples in accordance with the teachings of the present invention may be used in conjunction with other types of circuits as well. For instance, many self-biased multi-stable circuits other than bandgap reference circuits include amplifiers and may have a latched off state or other undesired state. For example, in another example in accordance with the teachings of the present invention, an apparatus includes a self-biasing electronic circuit including an amplifier and having multiple stable operating states responsive to an output of the amplifier. A state control circuit can be coupled to the electronic circuit to sense an output of the electronic circuit and to provide, at an input of the amplifier, a drive signal responsive to the sensed output.

The drive signal causes the electronic circuit to avoid the undesired state. This may involve causing the electronic circuit to avoid entering the undesired state, causing the electronic circuit to transition out of the undesired state, and causing the electronic circuit to transition into one of the multiple states that is different from the undesired state.

Figure 3:
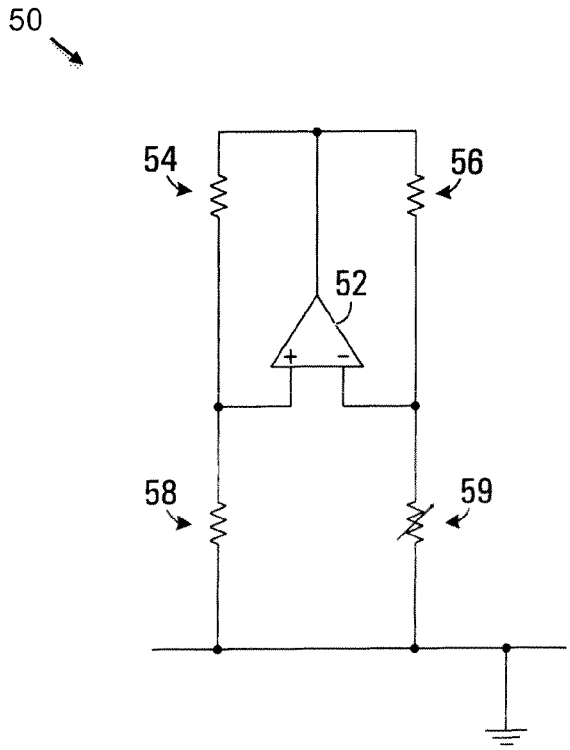
FIG. 3 is an example schematic of another type of electronic circuit that may be utilized in accordance with the teachings of the present invention.

It should be apparent from the foregoing that a bandgap reference circuit is one example of a self-biased multi-stable circuit in conjunction with which a state control circuit could be implemented in accordance with the teachings of the present invention. FIG. 3 shows generally an example schematic of another type of electronic circuit that may be utilized in accordance with the teachings of the present invention.

In particular, the example circuit shown in FIG. 3 is a bridge circuit 50 that includes an amplifier 52, which is illustrated in the form of an opamp, three resistors 54, 56 and 58, and a variable impedance element 59. This type of circuit may be utilized in sensor applications, for example, where the impedance of the element 59 varies in response to a quantity being sensed. The output of the bridge circuit 50 is the output of the amplifier 52 in this example, and also varies with the impedance of the variable impedance element 59.

In one example, a state control circuit could be used substantially as described above in FIG. 1 to prevent a latched off state of the amplifier 52. An output of the circuit could be sensed across any of the resistors 54, 56 or 58, for example. By providing a drive current to the amplifier 52, the latched off state can be avoided at startup and/or during operation. Thus, the amplifier 52 can be driven to avoid remaining in the latched off state at startup, and/or to pull the amplifier 52 out of the latched off state if it latches off during operation.

The principles disclosed herein may also be applied to circuits having more than two stable states in accordance with the teachings of the present invention. A foldback limit circuit, for example, may be considered to have an off state, a normal operating state and a foldback state during which current is being limited. Foldback limit circuits often use amplifiers to provide the current limiting function. If the circuit output is folded back to zero, or even near zero, the circuit can latch off. This can potentially be prevented by providing a drive signal to an amplifier in the circuit to avoid the latched off state at startup or during operation in accordance with the teachings of the present invention. In this case, there are two desired operating states and an undesired latched off state.

Examples in accordance with the teachings of the present invention thus provide for state control of self-biased multi-stable electronic circuits. Indeed, overdriving an amplifier output can be difficult, especially where the output has a low impedance and high current sinking capability, as is often the case, or after initial startup. Providing a drive signal at an amplifier input in accordance with the teachings of the present invention enables a state control capability with much lower currents, due to the relatively high input impedance that is typical in amplifier designs. In one example, the current source 34 shown in FIG. 1 supplies a total current Ibias of only 0.8 μA.

The above description of illustrated examples of the present invention, including what is described in the Abstract, are not intended to be exhaustive or to be limitation to the precise forms disclosed. For example, examples in accordance with the teachings of the present invention may be useful for avoiding an undesired state at startup. However, the disclosed techniques could also or instead be used to avoid such states during operation. A drive signal could be provided to an input of an amplifier to prevent the amplifier from latching off during normal operation, or to pull the amplifier out of the latched off state in the event that it latches off after startup.

In the case of a multi-stable circuit, it may be possible to provide different levels of drive signal depending on the alternate state into which operation of the amplifier or circuit is to be driven. For a circuit having two normal operating states and a latched off state for instance, different drive signal levels might be used to favor the two different normal operating states.

In addition, while specific embodiments of, and examples for, the invention are described herein for illustrative purposes, various equivalent modifications are possible without departing from the broader spirit and scope of the present invention. Indeed, it is appreciated that the specific voltages, currents, times, etc., are provided for explanation purposes and that other values may also be employed in other embodiments and examples in accordance with the teachings of the present invention.

What is claimed is:

1. An apparatus comprising:

a bandgap reference circuit having an operating state and a latched off state, the bandgap reference circuit including an amplifier to provide a bandgap reference voltage when the bandgap reference circuit is in the operating state; and a state control circuit coupled to sense an output signal of the bandgap reference circuit and coupled to provide a drive signal to an input of the amplifier in response to the sensed output signal, the drive signal to cause the bandgap reference circuit to avoid the latched off state.

2. The apparatus of claim 1, wherein the drive signal is a current injected at the input of the amplifier.

3. The apparatus of claim 1, wherein the state control circuit includes a pair of controllable switches coupled together in a differential input pair, each of the pair of controllable switches having a control terminal and a conductive path, wherein the sensed output signal is coupled across the control terminals, and wherein the conductive path of one of the pair of controllable switches is coupled to the input of the amplifier to provide the drive signal.

4. The apparatus of claim 3, wherein the pair of controllable switches include transistors.

5. The apparatus of claim 4, wherein the transistors are of different sizes.

6. The apparatus of claim 3, wherein the state control circuit further comprises a current source coupled to the conductive paths of the pair of controllable switches.

7. The apparatus of claim 3, wherein the state control circuit further comprises a dummy load coupled to the conductive path of an other of the pair of controllable switches.

8. The apparatus of claim 7, wherein the dummy load comprises a further controllable switch having a conductive path and a control terminal both coupled to the conductive path of the other of the pair controllable switches.

9. The apparatus of claim 1, wherein the amplifier includes non-inverting and inverting inputs and an output, wherein the bandgap reference circuit further includes respective transistors coupled to the non-inverting and inverting inputs of the amplifier, the transistors being further coupled to the output of the amplifier, and wherein the state control circuit provides the drive signal to one of the respective transistors that is coupled to the non-inverting input of the amplifier.

10. The apparatus of claim 9, wherein the bandgap reference circuit further includes respective resistors coupled between the output of the amplifier and the non-inverting and inverting inputs of the amplifier, and a further resistor coupled between the inverting input of the amplifier and the one of the respective transistors that is coupled to the inverting input.

11. A method comprising:

sensing an output of a bandgap reference circuit, the bandgap reference circuit having an operating state and a latched off state and including an amplifier to provide a bandgap reference voltage when the bandgap reference circuit is in the operating state; and providing a drive signal to an input of the amplifier in response to the sensed output signal, the drive signal to cause the bandgap reference circuit to avoid the latched off state.

12. The method of claim 11, wherein providing the drive signal comprises injecting a current at the input of the amplifier.

13. The method of claim 11, wherein providing comprises using the sensed output signal as a differential input signal coupled to a pair of controllable switches that are coupled together in a differential input pair, the controllable switches having respective control terminals for receiving the differential input signal and respective conductive paths, with the conductive path of one of the controllable switches being coupled to the input of the amplifier to provide the drive signal.

14. An apparatus comprising:

a self-biasing electronic circuit including an amplifier, the self-biasing electronic circuit having multiple stable operating states responsive to an output of the amplifier, the multiple stable operating states including an undesired state; and a state control circuit coupled to the self-biasing electronic circuit, the state control circuit coupled to sense an output of the self-biasing electronic circuit, the state control circuit coupled to provide to an input of the amplifier a drive signal in response to the sensed output, the drive signal to cause the electronic circuit to avoid the undesired state.

15. The apparatus of claim 14, wherein the drive signal is coupled to cause the self-biasing electronic circuit to avoid entering the undesired state.

16. The apparatus of claim 14, wherein the drive signal is coupled to cause the self-biasing electronic circuit to transition out of the undesired state.

17. The apparatus of claim 14, wherein the drive signal is coupled to cause the self-biasing electronic circuit to transition into one of the multiple states other than the undesired state.

18. The apparatus of claim 14, wherein the self-biasing electronic circuit comprises a bandgap reference circuit.

19. The apparatus of claim 14, wherein the self-biasing electronic circuit comprises a bridge circuit.

* * * * *